United States Patent [19]

Dallaire et al.

[11] Patent Number: 5,016,526

[45] Date of Patent: May 21, 1991

[54] VENTILATED SLIDING CLOSURE ASSEMBLY

[75] Inventors: Raymond Dallaire; Dominique Dallaire, both of St. David, Canada

[73] Assignee: Dallaire Industries Ltd., Lauzon, Canada

[21] Appl. No.: 435,029

[22] Filed: Nov. 13, 1989

[51] Int. Cl.[5] ..... E06B 7/02

[52] U.S. Cl. ..... 98/98

[58] Field of Search ..... 98/87, 88.1, 98

[56] References Cited

FOREIGN PATENT DOCUMENTS

| | | | |
|---|---|---|---|
| 1934996 | 1/1971 | Fed. Rep. of Germany | 98/99.01 |
| 3013440 | 10/1981 | Fed. Rep. of Germany | 98/99.6 |
| 2074716 | 11/1981 | United Kingdom | 98/98 |
| 2081881 | 2/1982 | United Kingdom | 98/98 |
| 2083202 | 3/1982 | United Kingdom | 98/87 |

*Primary Examiner*—Harold Joyce

*Attorney, Agent, or Firm*—Thomas J. Dodd

[57] ABSTRACT

A ventilated sliding closure having a ventilator integral with the frame head. The closure includes a frame which consists of a frame head, a sill and two vertical jambs. The frame supports two or more panels, at least one of which is a horizontally sliding panel. The frame head includes two parallel spaced apart support rails which engage longitudinal grooves in the top rails of each panel. The support rails include apertures which provide an air flow path through the frame head. A closure of the hit-and-miss type for the apertures is preferably included in the frame head to provide selective control of the ventilation.

23 Claims, 7 Drawing Sheets

VENTILATED SLIDING CLOSURE ASSEMBLY

BACKGROUND OF THE INVENTION

The present invention relates to closure assemblies, in particular sliding closure assemblies such as patio doors, horizontal sliding windows and the like. More particularly, the present invention relates to a sliding closure assembly with a ventilator integrated into the frame.

Sliding closure assemblies conventionally include a frame which consists of a head, a sill and two vertical jambs that support two or more panels of which one or more are horizontally sliding panels. Each such panel has a sash which includes a pair of horizontal rails and a pair of vertical stiles that surround and support one or more sheets of glazing material. The top and bottom rails of the panels are affixed to or guided in the head and the sill of the frame respectively. The sliding panels of a closure assembly usually further include a lock mechanism in one style for securing the panels in a closed condition.

Building regulations or customer requests frequently require the provision of a ventilator which is integrated into the closure assembly, especially if there is no other ventilation readily available in a room. The simplest way of providing ventilation using a closure assembly is to leave the sliding panel in a partially open condition. Although it is possible to provide a lock mechanism for securing a sliding panel in a partially open condition, such provision does not satisfactorily prevent break-ins and affords no protection against the intrusion of rain water.

Another common practice is the incorporation of a ventilator which replaces a portion of the glazing at the top or the side of a panel. However, such a ventilator obstructs the view through the panel, and results in an asymmetrical construction which lacks aesthetic appeal. This method also requires the use of customized glass panels and other parts which increase the cost of production.

Another approach to the problem has been to provide a gap between a subframe and the frame of a closure assembly along its top or sides to accommodate a ventilator. This approach yields a closure assembly which will not fit a rough opening built to accommodate a standard sliding closure assembly, unless the panels are reduced in size to compensate for the space lost to the subheader. Either way, production costs are increased and standards are sacrificed.

Ventilators are also incorporated in the sash of a panel by cutting a slot or boring holes through a rail or a stile of one or more panels, thereby maintaining a standard sized closure opening and avoiding any obstruction of the view. However, such ventilators greatly reduce the integrity and strength of the sash and the achievable volume of air flow through such ventilators is usually insufficient to meet building codes.

Thus, all the known prior art ventilators described above are either unattractive, require additional parts which raise production costs, fail to meet standards or reduce the strength and integrity of the sash.

For economy and aesthetics, it is desirable to integrate a ventilator into the head of the frame of a sliding closure assembly. British Patent No. 2,074.716 discloses a head for a sliding door or window frame having a ventilator section and an unventilated section. The ventilator section includes apertures to permit the flow of air from the outside to the inside though the frame head.

The ventilated section of the frame is located above and alongside of the sliding panel of a horizontally sliding door or window. The frame head is an inverted channel having an inner and an outer wall. An insert is mounted in the frame head for guiding a sliding panel along the outside of the fixed panel. The insert includes a vertical wall and a horizontal wall. Apertures are provided in the vertical wall of the insert and either in the horizontal wall of the insert or the inner wall of the frame head. A shutter is provided for closing the apertures. The sliding panel is guided between the outer wall of the frame head and the vertical wall of the insert by guides in the form of plastic buttons located on both sides of the head rail of the sliding panel. Air enters between the outer wall of the head and the outer surface of the top rail of the sliding panel.

One disadvantage of the ventilator for a sliding window or door described above is that the ventilation capacity (cc. per minute) is insufficient to meet the requirements of some building codes. Another disadvantage is that weather stripping can only be applied to the inner surface of the top rail of the sliding panel. This does not reliably prevent the leakage of air around the sliding panel during inclement weather conditions. High winds may even cause rain water to seep around the top rail of the sliding panel and into the building. It is a further disadvantage that the sliding panel of this system must always be located outside of the fixed panel and is not readily convertible to a system having a sliding panel on the inside. In addition, the shutter for the ventilation apertures in the frame head or the insert is clearly visible. This gives the interior of the sliding window or door an asymmetrical appearance that is not aesthetically pleasing.

SUMMARY OF THE INVENTION

It is an object of the present invention to provide a sliding closure assembly which is ventilated along the entire length of its frame head, regardless of the number or type of panels in the assembly.

It is a further object of the invention to provide a frame head which includes double weather stripping for each panel in the assembly.

It is yet a further object of the present invention to provide a sliding closure assembly which permits the sliding panel(s) to be located on either the outside or the inside of the assembly, and reversed in their locations even after installation of the sliding closure assembly is complete.

It is yet a further object of the invention to provide a sliding closure assembly wherein the ventilator portion of the assembly is substantially concealed so that the ventilated door or window has practically the same appearance as a conventional, unventilated door or window.

These and other objects are achieved in a ventilated, sliding closure assembly in accordance with the present invention. The sliding closure assembly includes at least two panels, at least one being a sliding panel and a frame having jambs, a head and a sill. Each panel in the assembly has a sash which includes two stiles, a top rail and a bottom rail. The frame head has an inner face and an outer face and first and second parallel support rails which are located between the faces of the frame head and engage a longitudinal groove in the top rails of the panels. The support rails include ventilation apertures which permit the passage of air over the respective top rails of each panel. The gap between the parallel support rails is closed by snap-in closures which isolate the ventilation apertures from the top rail of each panel.

A third support rail may be included in the head for guiding the top rail of a fly-screen door. Each support rail is preferably a box structure but may be a web having a continuous rail affixed to its bottom end, or vertical posts which support a continuous rail or a box structure or the like. The support rails may have any cross-sectional shape which is suitable for engaging an opening in the top or the sides of the top rails of the panels, although a substantially rectangular shape for engaging a U-shaped groove in the top rails is preferred. The bottom end of the support rails is also preferably sized to fit precisely in the groove in the top rail of the panel it engages. The support rails are preferably an integral part of the frame head structure however those skilled in the art will readily appreciate that they may be snap-in extrusions or independent structures which are attached to the frame head with screw fasteners or the like.

Weather stripping is provided between the inner surfaces of the grooves in the top rail of each panel and the respectively adjacent outer surfaces of the support rails to provide a double weather seal along the top of each panel. The support rail for the sliding panel guides the top rail of the sliding panel and thereby obviates any requirement for guide means between the inner or outer face of the frame head and an adjacent surface of the sliding panel top rail. The gap between the top rail of the sliding panel and the adjacent face of the frame head is therefore not obstructed and the resulting flow of ventilating air therethrough is maximized. The ventilation apertures in the support rail located on the outside of the frame head are covered with fly-screen. The ventilation apertures in the support rail located on the inside of the frame head are covered with a shutter of the hit-and-miss type for controlling ventilation. The inner face of the frame head conceals the shutter from view.

Thus, in accordance with the invention, there is provided a ventilated sliding closure assembly comprising:

at least two panels, at least one of said panels being a horizontally sliding panel;

a frame including jambs, a frame head and a sill for supporting said panels:

said frame head including first and second spaced apart parallel support rails for guiding the top rail of said sliding panel and removably affixing the top rail of any fixed panels;

said support rails including ventilation apertures and defining a ventilation chamber between their opposing sides, said chamber being closed by a bottom wall;

said ventilation apertures permitting a flow of air though said frame head; and said bottom wall blocking the passage of air through said frame head except that which flows through said apertures.

BRIEF DESCRIPTION OF THE DRAWINGS

A preferred embodiment of the invention will now be further described by way of example only and with reference to the following drawings, wherein.

DETAILED DESCRIPTION OF THE PREFERRED EMBODIMENT

Figure 1A:
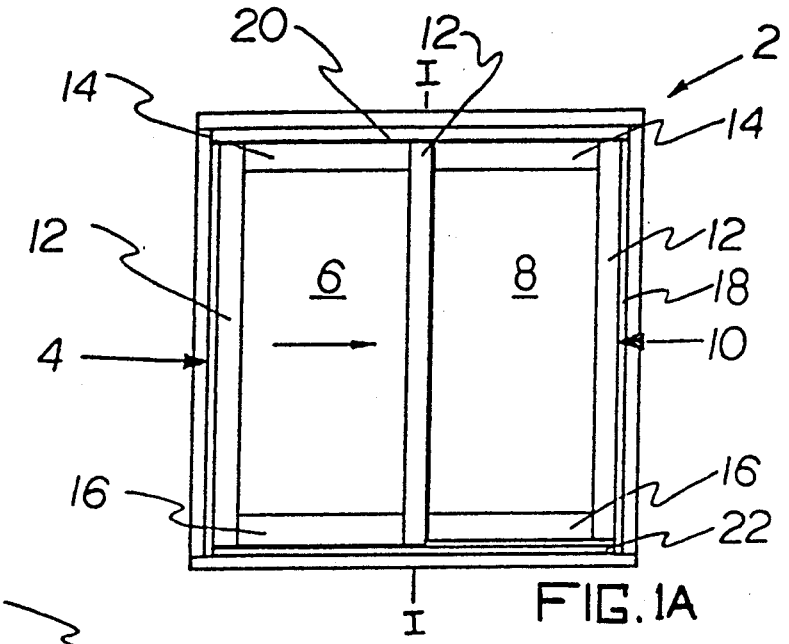
FIG. 1A is a front elevational view of three a two panel sliding closure assembly in accordance with the invention.
Figure 1B:
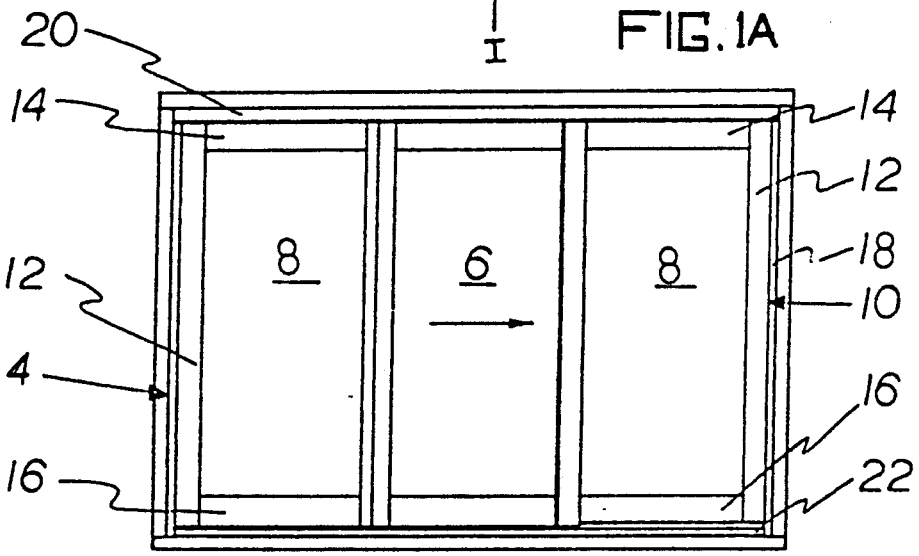
FIG. 1B is a front elevational view of a three panel sliding closure assembly in accordance with the invention.
Figure 1C:
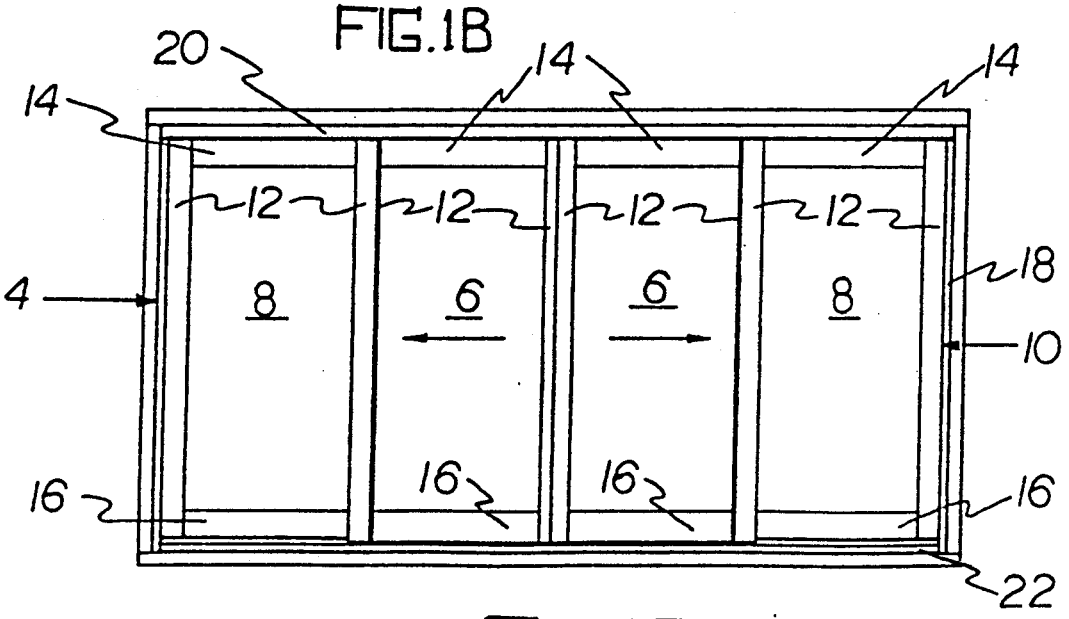
FIG. 1C is a front elevational view of a four panel sliding closure assembly in accordance with the invention.

FIGS. 1A–C show three examples of a ventilated sliding closure assembly in accordance with the invention, generally referred to by the reference 2, having a frame 4, sliding panels 6 and fixed panels 8. Each of the panels has a sash 10 which includes vertical stiles 12, a top rail 14 and bottom rail 16. Frame 4 includes jambs 18, a frame head 20 and a sill 22.

Figure 2:
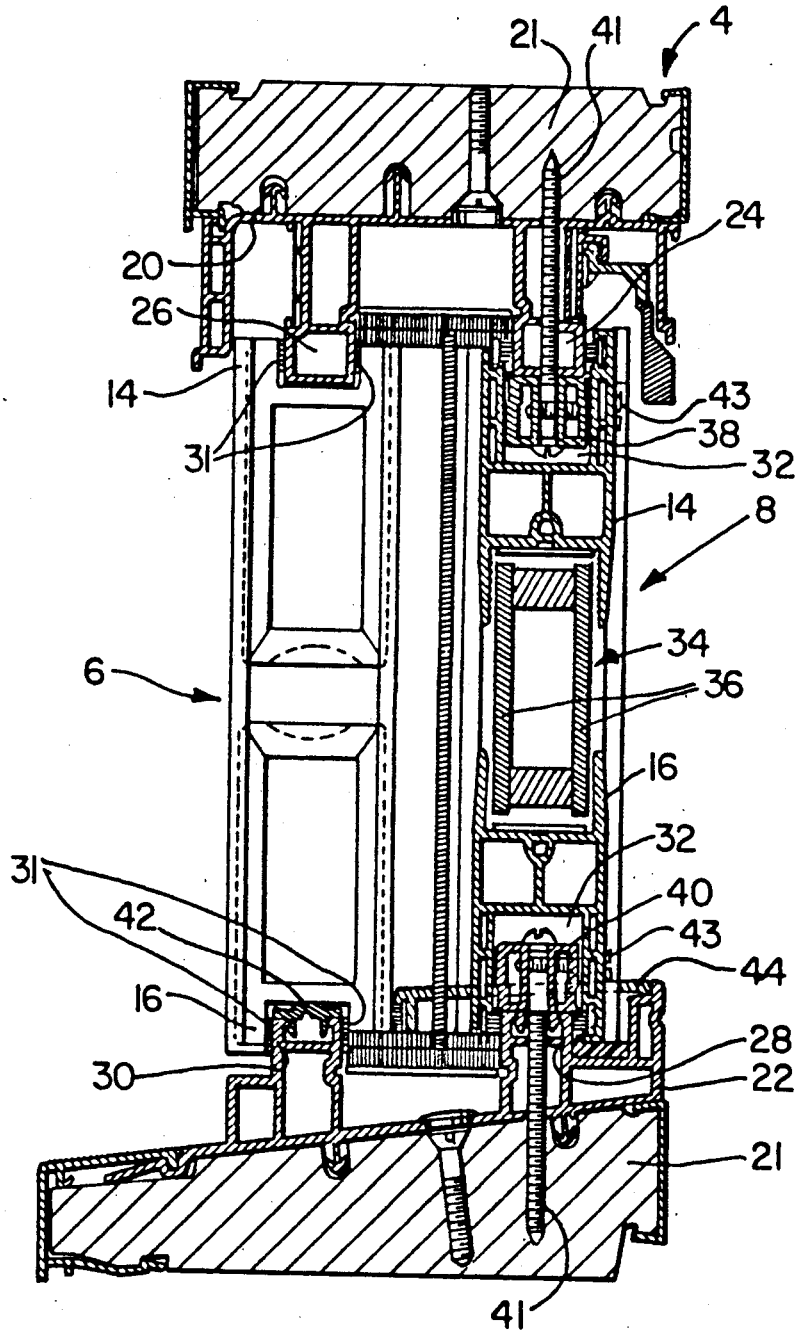
FIG. 2 is a vertical cross-section along line I—I of the two panel sliding closure shown at the top of FIG. A.

FIG. 2 shows the parts of the frame 4 at the cross-sectional cut I—I (see FIG. 1). Frame 4 includes a sub-frame 21, preferably made of wood though other materials are also suitable, a frame head 20 and sill 22. The frame head 20 includes first and second support rails 24 and 26 respectively. The sill 22 includes first and second sill tracks 28 and 30 respectively. The ends of support rails 24 and 26 engage U-shaped channels 32 in the top rails 16 of the sliding panel 6 and the fixed panel 8 respectively. The sill tracks 28 and 30 respectively support the bottom rails 14 of sliding panel 6 and the fixed panel 8. It should be noted that the support rails 24 and 26 and the sill tracks 28 and 30 are respectively identical and permit the sliding panel to be located on either the inside or the outside of the door or window closure. Weather stripping 31 is preferably positioned along the inner top edges of the U-shaped panels 32 and contact the sides of the support rails 24 and 26 and the sill tracks 28 and 30 to provide a weather seal for inhibiting the passage of air around the tops and bottoms of the panels. The ends of the panels are provided with weather stripping at the jambs and meeting rails in a manner well known in the art. The stiles 12 (FIG. 1), head rail 14 and bottom rail 16 of each panel support glazing 34 which includes one or more sheets of glazing material 36. Glazing 34 may be any suitable material and is a matter of design choice.

The fixed panel of the closure assembly is removably attached to the frame head 20 and sill 22 with attachment rails. A top attachment rail 38 is attached to the inner or outer support rail 24 or 26 and a bottom attachment rail 40 is attached to the opposing inner or outer sill track 28 or 30. The fixed panel attachment rails 38 and 40 are attached to the respective support rails with screw fasteners 41 which are long enough to anchor the attachment rails to the subframe for added strength. The screw fasteners also permit the removal of the attachment rails and the reversal of the fixed and the sliding panels, should same be required after assembly of the unit. The top and bottom rails 16 and 14 of the fixed panel 8 are likewise preferably screwed to the upper or lower attachment rails 3B and 40 respectively using screw fasteners 43. The sliding panel 6 is provided with rollers (not illustrated) which are mounted to the bottom rail 14 of sliding panel 6 and run over a roller track 42 mounted on the sill track 30 of sill 22 in a manner well known in the art. A removable tread section 44 is installed over and affixed to that part of the sill which lies between the outer end of the fixed panel 8 and the opposing jamb. The removable tread section 44 protects the sill track 28 and provides a level surface for traffic through the door.

Figure 3:
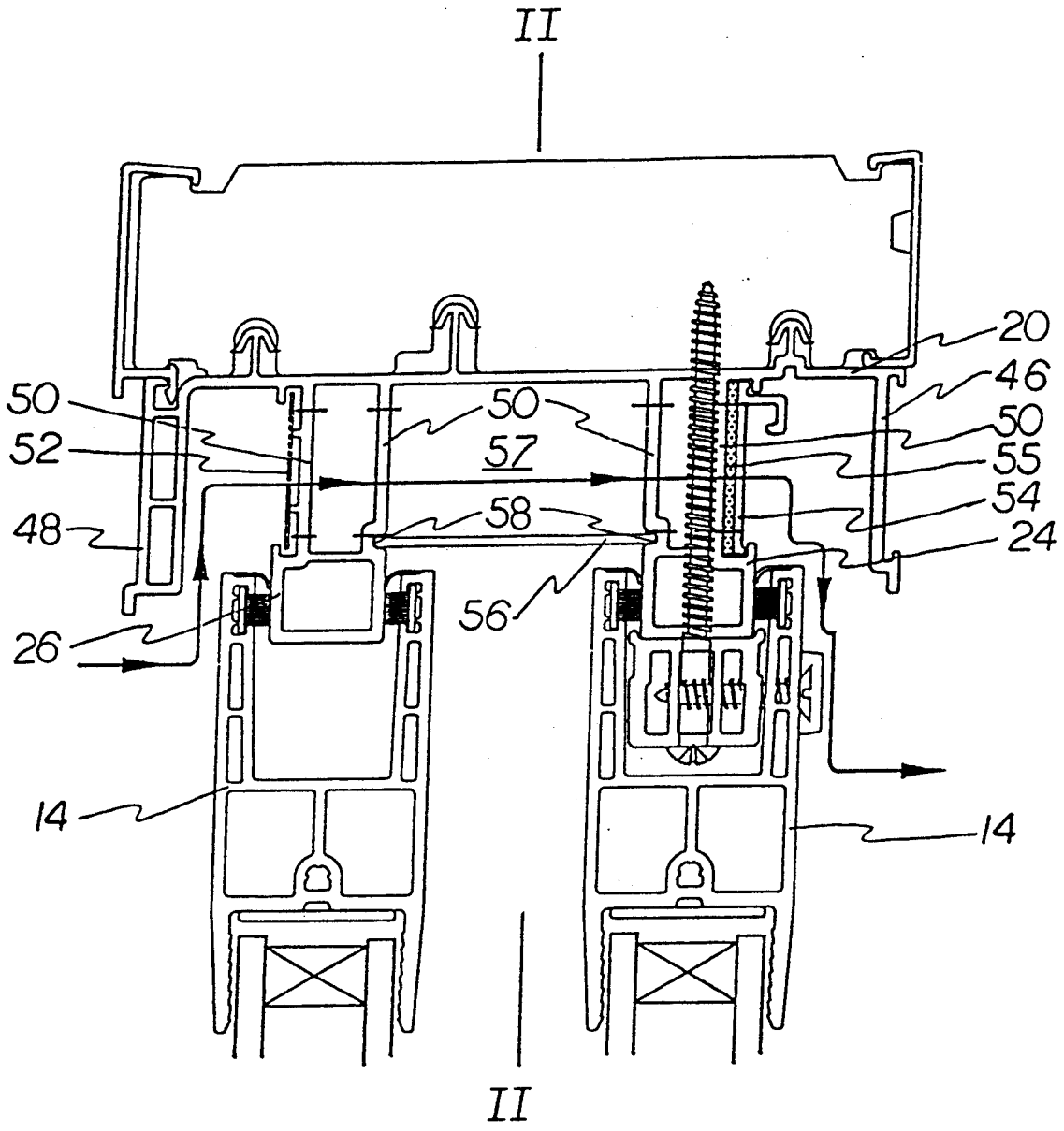
FIG. 3 is a partial view of a vertical cross-section through the frame head and the center of each panel and illustrates a flow path for ventilation air through the head.

Referring now to FIG. 3, which shows a partial vertical cut through the frame head and the center of each panel, it is apparent that frame head 20 includes an inner face 46, an inner support rail 24, an outer support rail 26 and an outer face 48. Apertures 50 are provided in the support rails 24 and 26. Apertures 50 are preferably cut through the support rails 24, 26 from inside a vent chamber 57 to avoid piercing the inner face 46 of frame head 20. If the equipment is not available for cutting the aperatures from the vent chamber 57, the apertures must be cut from the side of frame head 20. If the apertures must be cut from the inner face 46, a cover plate (not illustrated) is preferably attached to the outer surface of inner face 46 to cover the resulting holes. A screen 52, made of nylon or any other suitable material, is affixed to the outer surface of the outer support rail 26 above the region of contact between the support rail 26 and the top rail 14 of the sliding panel. The screen 52 completely covers the apertures in the outer surface of the support rail. The screen may be a continuous strip which extends along the entire length of support rail 26 or several screen sections which cover one or more apertures each. A vent closure 54 of the hit and miss type is slidably supported on the inner surface on the inner support rail 24 for selectively closing the apertures 50 in that surface. A sealing felt 55 is affixed to the vent closure 54 and is correspondingly perforated with apertures that match the apertures in the vent closure.

Figure 4:
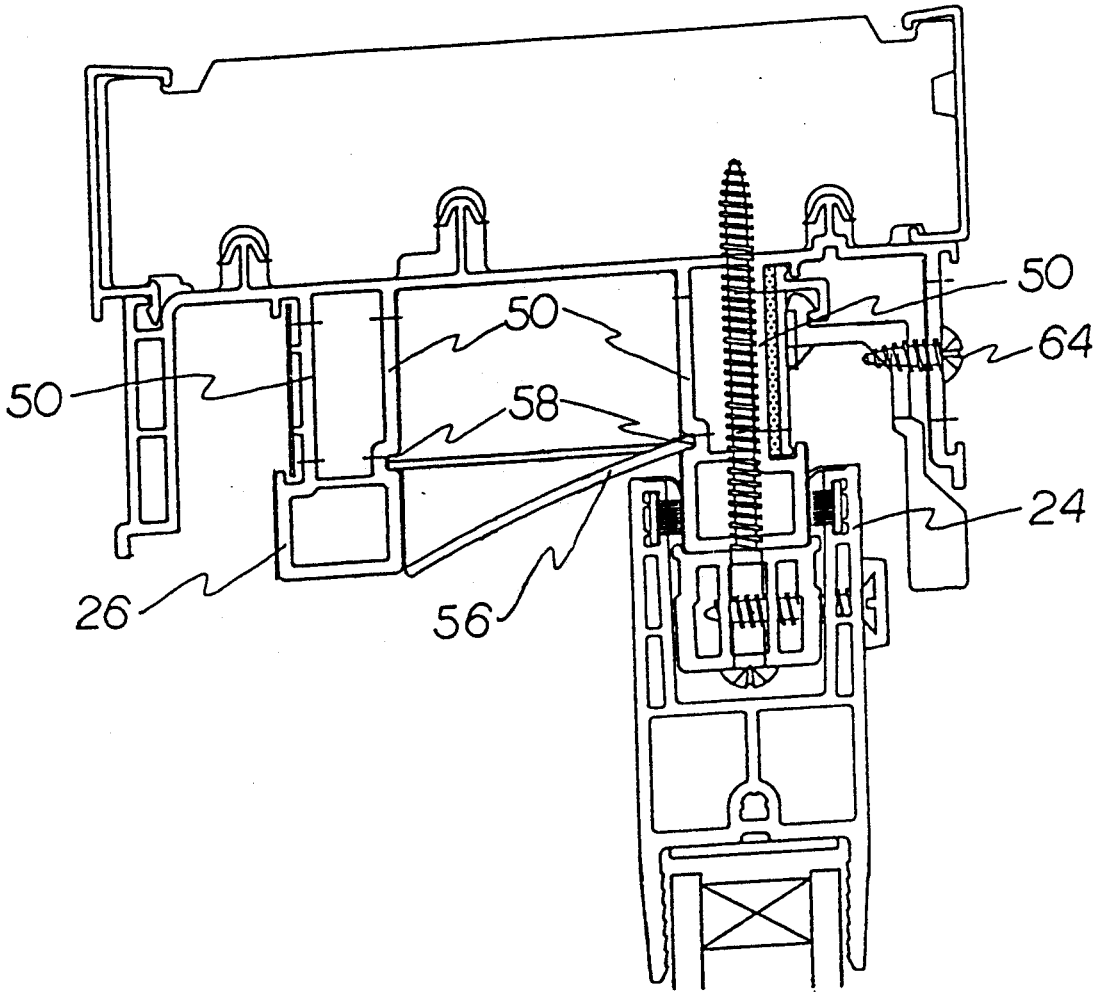
FIG. 4 shows the embodiment of FIG. 3 partially assembled.

As shown in FIG. 4, the opposing support rails 24 and 26 define a vent chamber 57 between their inner walls. The vent chamber 57 must be sealed to prevent the intrusion of ventilation air into the building when vent closure 54 is closed. A vent chamber bottom wall 56, hereinafter referred to as bottom wall 56, engages a longitudinal groove 58 on each of the two opposing inner surfaces of the support rails to confine the flow of air to apertures 50. The flow path for ventilating air (arrows) passes between the inner surfaces of the outer and inner faces of the frame head 20 and the respectively adjacent surfaces of the top rails 14 and through apertures 50 when vent closure 54 is in an open condition. It is readily apparent that the air may flow in the indicated direction as well as in the opposite direction and that the direction of flow is dictated by differences in the air pressure on each side of the sliding closure assembly. The vent closure 54 is provided with a control lever 60 to facilitate the operation of the vent closure. Control lever 60 is optional but preferred as it affords a convenient gripping surface for adjusting the position of the vent closure. An adjustment screw 64 (see FIGS. 4 and 5) may be positioned in inner face 46 of the frame head 20 to limit the opening movement of vent closure 54 so that the apertures 50 in the inner support rail 24 are completely blocked when the vent closure is in a closed condition. Adjustment screw 64 limits the opening movement of vent closure 54 by blocking the path of control lever 60.

Figure 5:
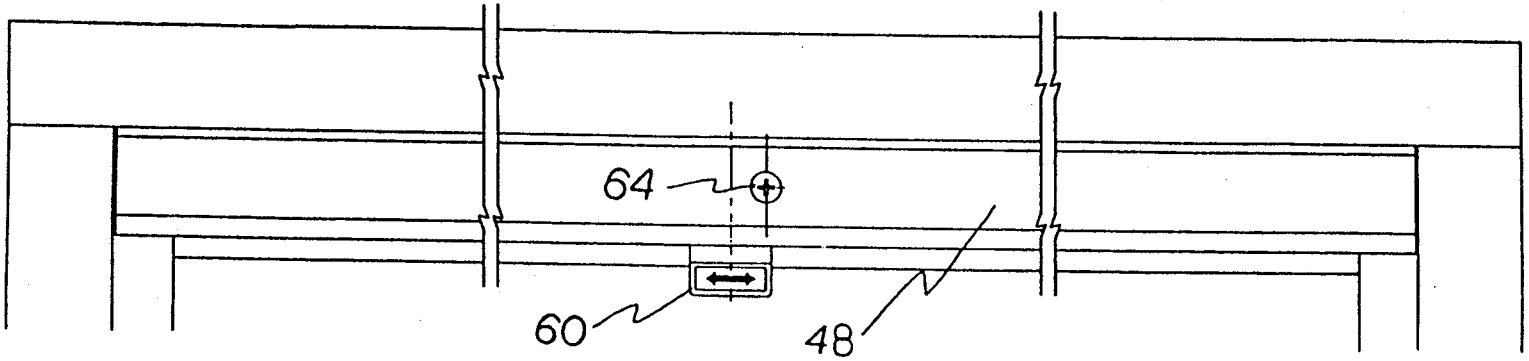
FIG. 5 is an elevational view of the frame head of the two panel sliding closure shown at the top of FIG. A.

FIG. 5 illustrates the insertion cf the bottom wall 56 into the longitudinal groove 58 for sealing the vent chamber. The bottom walls 56 (a minimum of two are required for each sliding closure as will become apparent hereinafter) are installed after the installation of all fixed and movable panels. The bottom walls 56 are installed by inserting an edge of the wall into one groove 58 and pressing upward on the middle of the wall until it deforms sufficiently to snap into place in the opposing groove 58.

FIG. 5 shows an elevational view of the head of a sliding closure assembly in accordance with the invention illustrating the appearance of the installed closure. It should be noted that the vent closure 54 and aperatures 50 are concealed by the inner face 46 of the frame head 20 so that only the lower end of control lever 60 is visible below the inner face of the frame head.

Figure 6:
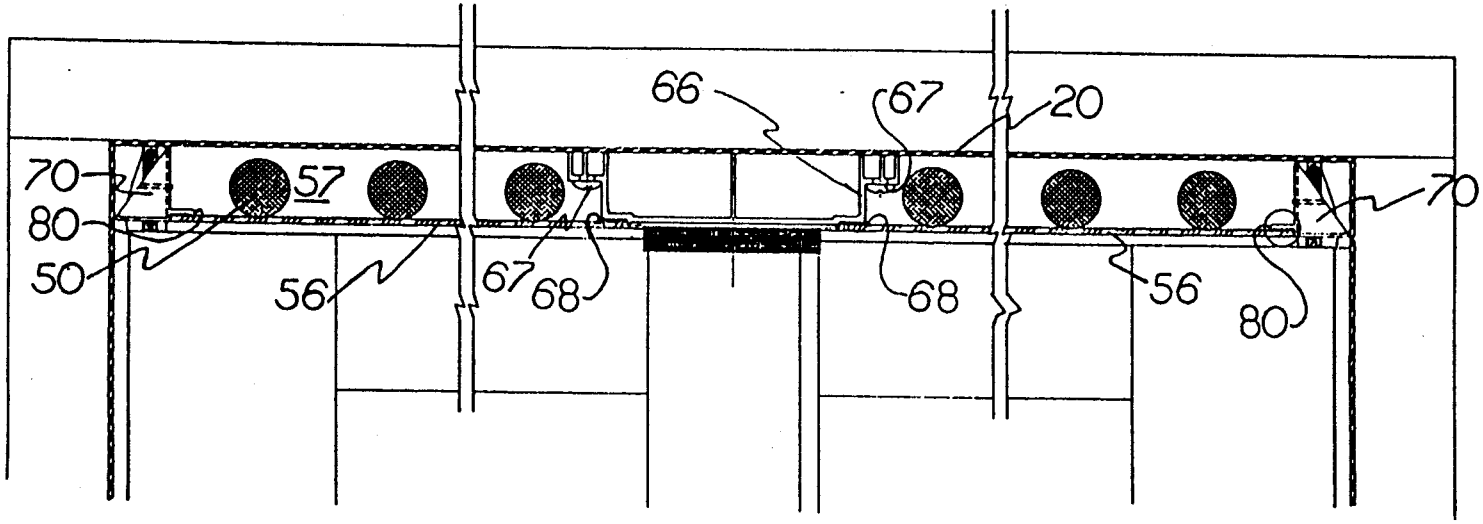
FIG. 6 is a cross-sectional view through the frame head along line II—II of FIG. 3.

FIG. 6 illustrates the positioning of the apertures 50 in the outer support rail 26 and the location of the vent chamber bottom walls 56. The apertures in the inner support rail 24 (see FIGS. 3 and 4) are preferably identically sized and positioned. A support rail reinforcement member 66 is mounted to the frame head 20 in the meeting region of the stiles of each adjacent pair of panels. The reinforcement member 66 is affixed to frame head 20 with screw fasteners 67 which anchor it to the subframe 21. The reinforcement member 66 serves to strengthen the resistance of the support rails to wracking forces in their weakest region, where the stiles meet and to support a woven pile weather strip. Reinforcement member 66 is preferably a channel extrusion which is manufactured in long sections and cut to lengths which fit snugly in the gap between the inner walls of the support rails 24 and 26. The reinforcement member 66 preferably includes a coextruded pliable weather stripping 68, polyvinylchloride for example, along each of its opposing shoulder regions. The weather stripping 68 cooperates with each bottom wall 56 to prevent the passage of ventilation air between the bottom wall 56 and the reinforcement member 66.

Figure 6A:
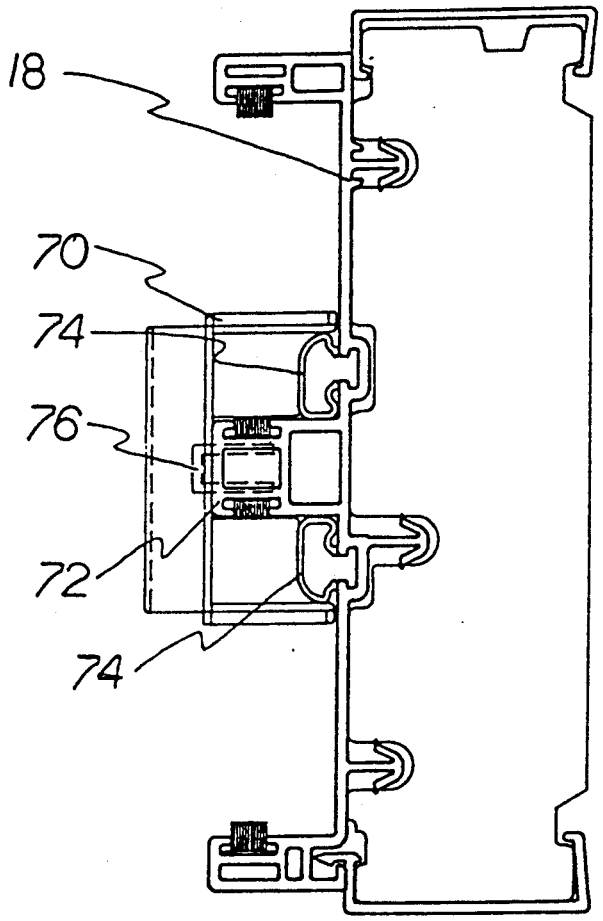
FIG. 6A is a horizontal cross-sectional view of the top of the jamb shown on the right hand side of FIG. 6.
Figure 7:
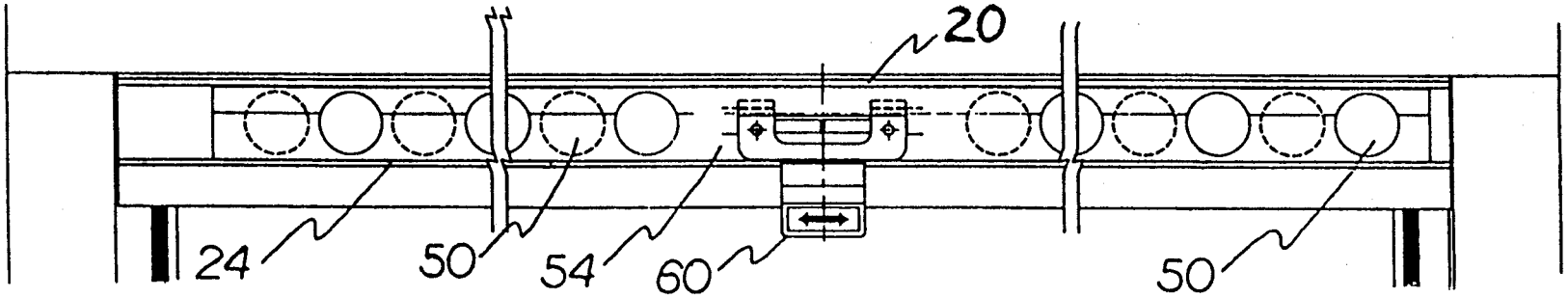
FIG. 7 is an elevational view of the frame head with the inner face of the frame head cut away, showing the ventilator in a closed condition.

To provide a neat, air resistant seal between the vent chamber bottom wall 56 and the jamb on each end of the closure, a vent chamber end bracket 70, hereinafter referred to as the end bracket 70, is provided. The shape of the end bracket 70 is more readily apparent in FIG. 6A. The end bracket 70 is contoured to fit closely around the jamb centre post 72 and cooperate with the pliable weather strips 74 to seal each end of the vent chamber 57. The end bracket 70 is connected to the jamb centre post 72 with a staple 76 which is driven though the end bracket 70 and into centre post 72. The end bracket is further provided with a downwardly projecting lip 80 on its outer bottom edge which cooperates with bottom wall 56 (see FIG. 6) to inhibit the passage of ventilation air between the end bracket 70 and the bottom wall 56. A caulking compound may be optionally added between the two surfaces to further improve the seal.

Figure 8:
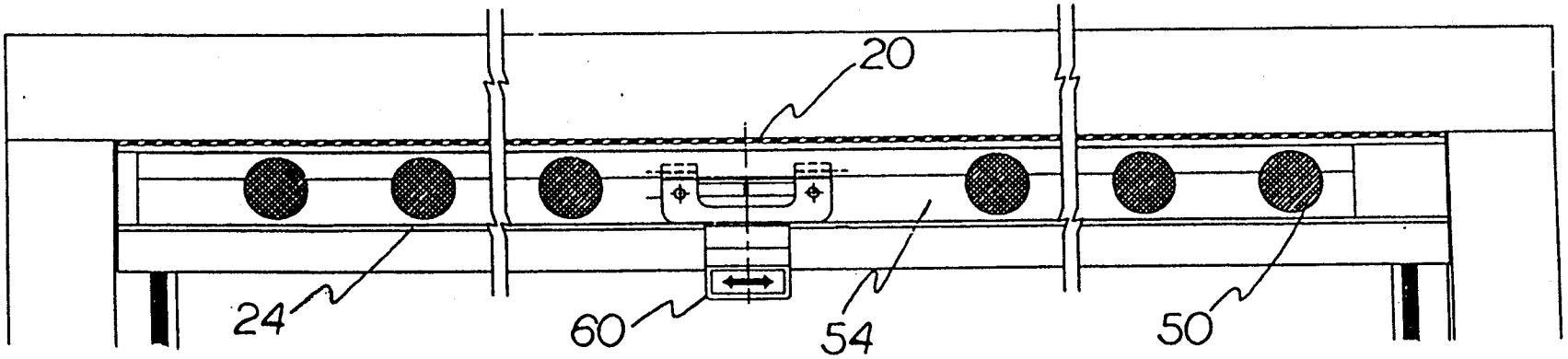
FIG. 8 is an elevational view of the frame head shown in FIG. 7 with the ventilator in an open condition.

The use of vent closure 54 will now be explained with reference to FIGS. 8 and 9. In the closed position of vent closure 54 as shown in FIG. 8, the apertures (dashed lines) in the inner support rail 24 of frame head 20 are completely covered by closure 54. Thus, the air flow path through the frame head is blocked. The leakage of air around vent closure 54 is substantially eliminated by a sealing felt 55 (see FIG. 4) attached to the rear surface of the closure. Movement of control lever 60 progressively opens an air flow path through the closure head (FIG. 9). In a completely open condition, the apertures 50 in closure port 54 and the apertures in the inner support rail 24 coincide for maximum air flow. The apertures in the support rails 24 and 26 and in vent closure 54 may be of practically any size, shape and number, so long as structural strength of the support rails is not severely compromised. In general, building code ventilation requirements are easily met or exceeded by standard sized doors or windows in accordance with the invention without undue compromise of the strength of the frame head.

Thus, the present invention provides a ventilated sliding closure assembly which fits the standard rough opening for a conventional unventilated assembly of the same panel size. The invention further provides improved ventilation in an aesthetically pleasing unit which permits the installation of the sliding panels on either side thereof.

Changes and modifications in the specifically described embodiments can be carried out without departing from the scope of the invention which is intended to be limited only by the scope of the appended claims.

We claim:

1. A ventilated sliding closure assembly which provides ventilation in a closure frame head over both a horizontally sliding and fixed panels, comprising:

at least two panels, at least one of said panels being the horizontally sliding panel;

a frame including jambs, the frame head and a sill for supporting said panels;

said frame head including first and second spaced apart parallel support rails for guiding a top rail of said sliding panel and removably affixing a top rail of any fixed panels;

said support rails including ventilation apertures and defining a ventilation chamber between their opposed sides which extends substantially the full length of the frame head, said chamber being closed by a bottom wall;

said ventilation apertures permitting a flow of air through said frame head; and said bottom wall blocking the passage of air through said frame head except that which flows through said apertures.

2. A ventilated sliding closure assembly as defined in claim 1, further comprising screen means mounted on at least one of said support rails and completely covering the apertures therein.

3. A ventilated sliding closure assembly as defined in claims 1 or 2, further comprising a vent closure for selectively closing the ventilation apertures in at least one of said support rails.

4. A ventilated sliding closure assembly as defined in claims 1 or 2 further comprising a vent closure for selectively closing the ventilation apertures in at least one of said support rails, said vent closure being provided with a control lever for facilitating the adjustment thereof.

5. A ventilated sliding closure assembly as defined in claim 1, wherein said sliding panel is located to the outside of said fixed panel.

6. A ventilated sliding closure assembly as defined in claim 1, wherein said sliding panel is located on the inside of said fixed panel.

7. A ventilated sliding closure assembly as defined in claims 1, 5 or 6, wherein the location of said fixed panel and said sliding panel is reversible even after complete installation of said sliding closure assembly.

8. A ventilated sliding closure assembly as defined in claim 1, wherein said frame is affixed to a subframe.

9. A ventilated sliding closure assembly as defined in claim 1, wherein said frame head includes an inner face and an outer face respectively spaced apart from and parallel with said first and second support rails.

10. A ventilated sliding closure assembly as defined in claim 9, wherein said inner face substantially conceals said ventilation apertures.

11. A ventilated sliding closure assembly as defined in claim 9 wherein said ventilation apertures are cut by piercing laterally from the side of said head through said inner face, said apertures in said inner face being concealed by an elongated cover affixed to the surface of said inner face.

12. A ventilated sliding closure assembly as defined in claims 1 or 2 wherein said support rails are a solid vertical webs.

13. A ventilated sliding closure assembly as defined in claim 1, wherein said support rails have two vertical walls and a connecting horizontal bottom wall.

14. A sliding closure assembly as defined in claim 13, wherein said support rails further include inner reinforcing walls.

15. A ventilated sliding closure assembly as defined in claims 1 or 2 wherein said support rails comprise a continuous rail on their bottom edges for engaging an opening in said top rails, said continuous rail being supported intermittently from said frame head by interconnecting members.

16. A ventilated sliding closure assembly as defined in claim 1 wherein said support rails are manufactured independently of said frame head and are adhesively, frictionally or mechanically affixed to said frame head as a subassembly.

17. A ventilated sliding closure assembly as defined in claim 1 wherein said first and second support rails and said bottom wall for blocking the passage of air through said frame head except that which flows through said apertures comprise a single integral part.

18. A ventilated sliding closure assembly comprising:

at least two panels, at least one of said panels being a horizontally sliding panel;

a frame including jambs, a frame head and a sill for supporting said panels;

said frame head including integral first and second spaced part parallel support rails for guiding a top rail of said sliding panel and removably affixing a top rail of any fixed panels;

said support rails including ventilation apertures and defining a ventilation chamber between their opposed sides, said ventilation chamber being closed by a bottom wall, said apertures permitting a flow of air through said frame head and said bottom wall blocking the passage of air through said frame head except through said apertures;

screen means mounted on at least one of said support rails and completely covering the apertures therein;

a vent closure for selectively closing the ventilation apertures in at least one of said support rails, said vent closure being provided with a control lever for facilitating the adjustment thereof;

said frame head including an inner and an outer face respectively spaced apart from and parallel with said first and second support rails; and said inner face substantially concealing said ventilation apertures and said vent closure.

19. A ventilation sliding closure as defined in claim 18 wherein said panels include a U-shaped groove in their top rails adapted to slidably receive said support rails, said U-shaped groove being provided on each of its opposing longitudinal faces with weather stripping continuous along said faces, said weatherstripping cooperating with the sides of said support rails to prevent the flow of air between said penal top rails and said support rails.

20. A ventilated sliding closure as in claim 19 wherein said fixed panel is removably affixed to one said support rail by an attachment rail which is removably affixed to the bottom surface of said support rail with elongated screw fasteners driven vertically through both said support rails and said frame head and the top rail of said fixed panel is removably affixed to said attachment rail with screw fasteners driven laterally through at least one face of said top rail.

21. A ventilated sliding closure as in claim 19 wherein said vent closure is a closure of the hit-and-miss type.

22. A ventilated sliding closure as in claim 21 wherein said vent closure including a sealing felt affixed to its back surface and provided with apertures complimentary with the apertures in said vent closure.

23. A ventilated sliding closure as in claim 21 wherein said vent closure includes stop means for stopping the movement of said closure in a fully closed position.

* * * * *